US012644242B2

(12) United States Patent
Qian et al.

(10) Patent No.: US 12,644,242 B2
(45) Date of Patent: Jun. 2, 2026

(54) SNOW THROWER AND POWER TOOL

(71) Applicant: Nanjing Chervon Industry Co., Ltd., Nanjing (CN)

(72) Inventors: Chunsen Qian, Nanjing (CN); Jifeng Feng, Nanjing (CN); Peng Wang, Nanjing (CN); Toshinari Yamaoka, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 718 days.

(21) Appl. No.: 18/172,003

(22) Filed: Feb. 21, 2023

(65) Prior Publication Data

US 2023/0193575 A1 Jun. 22, 2023

Related U.S. Application Data

(63) Continuation of application No. PCT/CN2022/104553, filed on Jul. 8, 2022.

(30) Foreign Application Priority Data

Sep. 22, 2021 (CN) ..... 202111105119.1

(51) Int. Cl.
*E01H 5/04* (2006.01)

(52) U.S. Cl.
CPC ..... *E01H 5/045* (2013.01)

(58) Field of Classification Search
CPC ..... E01H 5/045; E01H 5/098; E01H 5/04; H05B 1/0236; H05B 2203/003; H05B 2203/014; H05B 1/0252
See application file for complete search history.

(56) References Cited

U.S. PATENT DOCUMENTS

| | | | | |
|---|---|---|---|---|
| 11,042,152 | B2 | 6/2021 | Towers | |
| 2004/0032749 | A1* | 2/2004 | Schindler | F21V 33/004 362/555 |
| 2004/0093767 | A1 | 5/2004 | Phillip | |
| 2005/0072772 | A1* | 4/2005 | Livingstone | B01D 53/228 219/494 |
| 2008/0272104 | A1* | 11/2008 | Farrington | H05B 3/42 219/201 |
| 2019/0135372 | A1 | 5/2019 | Knitt | |

FOREIGN PATENT DOCUMENTS

| | | | |
|---|---|---|---|
| EP | 3450290 | A1 | 4/2021 |
| JP | 2015107677 | A | 6/2015 |
| KR | 101984134 | B1 | 5/2019 |

* cited by examiner

*Primary Examiner* — Robert G Bachner

(74) *Attorney, Agent, or Firm* — Greenberg Traurig, LLP

(57) ABSTRACT

A power tool includes a handle assembly, a power supply, and a temperature control module; where the handle assembly includes a left grip and a right grip, where a first end of the left grip is coupled to a body of the power tool, a second end of the left grip is coupled to a first end of the right grip, and a second end of the right grip is coupled to the body of the power tool; the temperature control module is coupled to the handle assembly and the power supply separately; and the power supply is configured to power the temperature control module so that the temperature control module is configured to heat the handle assembly.

19 Claims, 11 Drawing Sheets

SNOW THROWER AND POWER TOOL

RELATED APPLICATION INFORMATION

This application is a continuation of International Application Number PCT/CN2022/104553, filed on Jul. 8, 2022, through which this application also claims the benefit under 35 U.S.C. § 119(a) of Chinese Patent Application No. 202111105119.1, filed on Sep. 22, 2021, which applications are incorporated herein by reference in their entirety.

BACKGROUND

Power tools can greatly reduce labor intensity, improve work efficiency, and implement the mechanization of manual operations. Therefore, the power tools are widely used in the fields of buildings, housing decoration, automobiles, machinery, electricity, bridges, gardening, and the like.

When a power tool is used in cold weather, a grip touched by an operator also has a relatively low temperature. Therefore, how to provide the operator with a comfortable working environment is an urgent problem to be solved.

SUMMARY

Examples of the present application provide a power tool, a handle system applicable to a power tool, and a snow thrower, which can provide an operator with a comfortable working environment. The technical solutions are described below.

In one aspect, the examples of the present application provide a power tool including a handle assembly, a power supply, and a temperature control module. The handle assembly includes a left grip and a right grip, where a first end of the left grip is coupled to a body of the power tool, a second end of the left grip is coupled to a first end of the right grip, and a second end of the right grip is coupled to the body of the power tool. The temperature control module is coupled to the handle assembly and the power supply separately. The power supply is configured to power the temperature control module so that the temperature control module is configured to heat the handle assembly.

In another aspect, the examples of the present application provide a handle system applicable to a power tool, where the handle system includes a handle assembly and a temperature control module. The handle assembly includes a grip and a temperature switch. The temperature control module is coupled to the grip. The temperature control module is configured to heat the grip. The temperature switch is disposed on a heating path from the temperature control module to the grip, the temperature switch is in an off state in a case where a temperature of the grip is higher than a first threshold, and the temperature switch is in an on state in a case where the temperature of the grip is lower than a second threshold.

In another aspect, the examples of the present application provide a snow thrower including the handle system as described in the preceding aspect.

DETAILED DESCRIPTION

Figure 1:
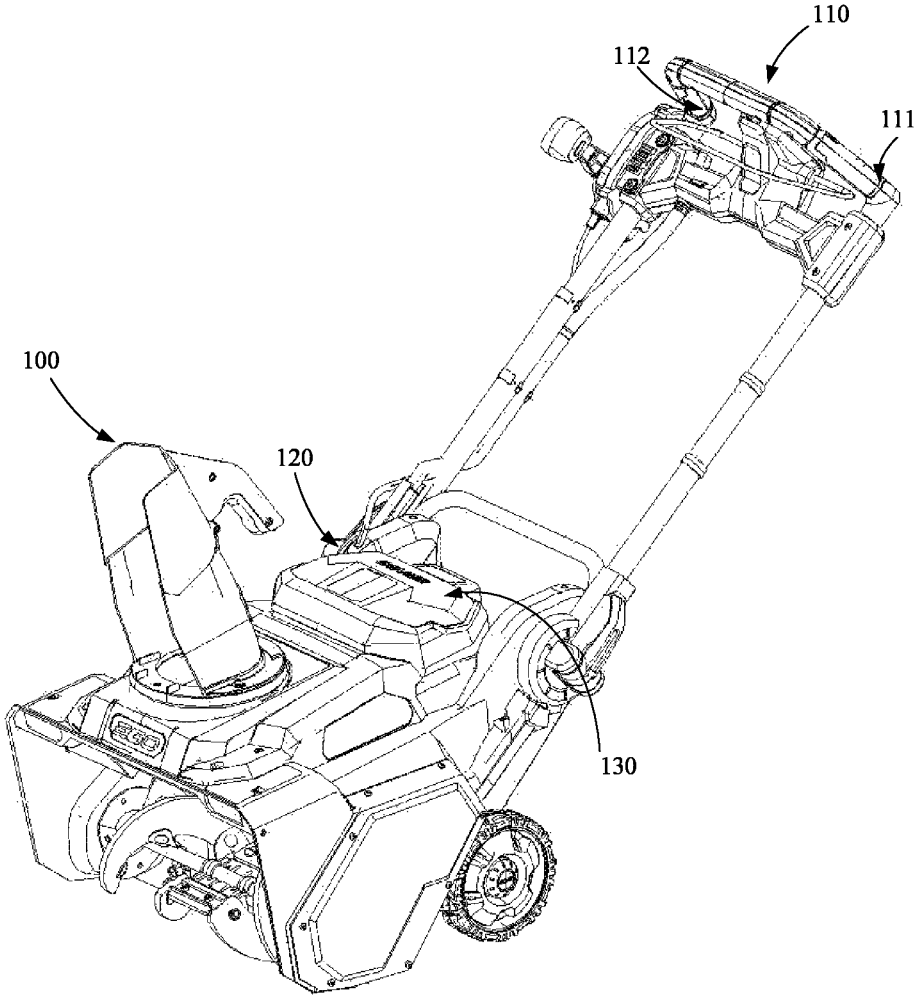
FIG. 1 is a schematic view of a power tool according to an example of the present application.

Referring to FIG. 1, a schematic view of a power tool according to an example of the present application is shown. For ease of description, in examples of the present application, an example in which the power tool is a snow thrower is used for illustration, but this should not limit the present application. The power tool provided by the present application is suitable for use in a low-temperature environment and includes, but is not limited to, a chain saw, an electric drill, a circular saw, a snow thrower, a string trimmer, and the like.

A power tool 100 includes a handle assembly 110, a power supply 130, and a temperature control module.

The handle assembly 110 includes a left grip 111 and a right grip 112, where one end of the left grip 111 is coupled to a body 120 of the power tool 100, the other end of the left grip 111 is coupled to one end of the right grip 112, and the other end of the right grip 112 is coupled to the body 120 of the power tool 100.

For example, the handle assembly 110 is operated by a user. The handle assembly 110 may also be referred to as a handle device, a handle module, or the like, which is not limited in the examples of the present application.

The left grip 111 and the right grip 112 are configured to be held by the user, where the left grip 111 may be configured to be held by the left hand of the user, and the right grip 112 may be configured to be held by the right hand of the user. The user may operate the power tool by operating the left grip 111 and the right grip 112. For example, when the power tool includes the snow thrower, the user may implement a steering operation of the snow thrower by operating the left grip 111 and the right grip 112.

For example, the left grip 111 and the right grip 112 may be directly coupled to each other, and the other end of the left grip 111 and the other end of the right grip 112 may be coupled to the body of the power tool through connecting rods. Alternatively, the left grip 111 and the right grip 112 may be coupled to each other through a connection portion, and the other end of the left grip 111 and the other end of the right grip 112 may be coupled to the body of the power tool through the connecting rods.

In an illustrative example, the handle assembly may include any one of a "U-shaped" handle assembly, a "linear" handle assembly, a "V-shaped" handle assembly, a "W-shaped" handle assembly, and an "O-shaped" handle assembly. The shape of the "U-shaped" handle assembly is similar to "U", the shape of the "linear" handle assembly is similar to a straight line, the shape of the "V-shaped" handle assembly is similar to "V", the shape of the "W-shaped" handle assembly is similar to "W", and the shape of the "O-shaped" handle assembly is similar to "O".

The temperature control module is coupled to the handle assembly 110 and the power supply 130 separately.

The temperature control module refers to a module configured to control heating temperatures of the left grip 111 and the right grip 112. For example, the temperature control module may also be referred to as a constant current source module.

The power supply 130 is configured to power the temperature control module so that the temperature control module heats the handle assembly 110.

For example, the power supply 130 may be a battery management system (BMS) module. The BMS module may be coupled to the temperature control module and a battery pack separately. The BMS module outputs +56 V directly to the temperature control module, and the temperature control module heats the left grip and the right grip based on the 56 V voltage.

For example, the power supply may be a battery pack configured to output a current to the temperature control module for the temperature control module to heat the left grip and the right grip.

In summary, in the technical solution provided by the examples of the present application, the temperature control module is powered by the power supply so that the temperature control module heats the handle assembly. Since the grip is a part which an operator needs to hold, a temperature of the grip affects the user experience of the operator. The grip is heated so that the part held by the operator has a relatively high temperature, thereby providing a comfortable working environment for the operator in a low-temperature environment.

In an illustrative example, the handle assembly also includes a first temperature switch and a second temperature switch.

The first temperature switch is disposed on a heating path from the temperature control module to the left grip, the first temperature switch is configured to be in an off state in the case where a temperature of the left grip is higher than a first threshold, and the first temperature switch is configured to be in an on state in the case where the temperature of the left grip is lower than a second threshold.

The second temperature switch is disposed on a heating path from the temperature control module to the right grip, the second temperature switch is configured to be in the off state in the case where a temperature of the right grip is higher than the first threshold, and the second temperature switch is configured to be in the on state in the case where the temperature of the right grip is lower than the second threshold.

For example, the current is output from the temperature control module and flows through the left grip, the first temperature switch, the right grip, and the second temperature switch. The temperature control module, the first temperature switch, the left grip, the right grip, and the second temperature switch constitute a series loop. When the temperature of the left grip reaches the first threshold or the temperature of the right grip reaches the first threshold, the preceding series loop is turned off; and when the temperature of the left grip reaches the second threshold and the temperature of the right grip is lower than the second threshold, the preceding series loop is turned on so that the temperatures of the left grip and the right grip are maintained within a certain temperature range.

For example, the temperature control module, the left grip, and the first temperature switch constitute a first series loop, and the temperature control module, the right grip, and the second temperature switch constitute a second series loop, where the first series loop and the second series loop are connected in parallel. The off/on state of the first temperature switch does not affect the heating of the right grip by the temperature control module, and the off/on state of the second temperature switch does not affect the heating of the left grip by the temperature control module, thereby improving flexibility. For example, the first series loop and the second series loop are connected in series. The off/on state of the first temperature switch affects the heating of the right grip by the temperature control module, and the off/on state of the second temperature switch affects the heating of the left grip by the temperature control module, thereby improving safety.

In an illustrative example, a first resistance wire is wound in the left grip, and the temperature control module is configured to heat the left grip by outputting a current to the first resistance wire; and a second resistance wire is wound in the right grip, and the temperature control module is configured to heat the right grip by outputting a current to the second resistance wire.

The first resistance wire is any resistance wire, and the second resistance wire is any resistance wire. In some examples, the first resistance wire and the second resistance wire are two different resistance wires. In some examples, the first resistance wire and the second resistance wire are two resistance wires of the same specification. The first resistance wire is wound in the left grip, and the second resistance wire is wound in the right grip. Multiple slots are disposed on the left grip, and the first resistance wire may be embedded in the multiple slots; and multiple slots are disposed on the right grip, and the second resistance wire may be embedded in the multiple slots.

One end of the first resistance wire is coupled to the first temperature switch, and the other end of the first resistance wire is coupled to the temperature control module; and one end of the second resistance wire is coupled to the second temperature switch, and the other end of the second resistance wire is coupled to the temperature control module. The first resistance wire may be wound in the left grip through single-wire winding, and the second resistance wire may be wound in the right grip through the single-wire winding. For example, the temperature control module, the first resistance wire, the first temperature switch, the second resistance wire, and the second temperature switch constitute a closed loop. For example, the temperature control module, the first resistance wire, and the first temperature switch constitute the first series loop, and the temperature control module, the second resistance wire, and the second temperature switch constitute the second series loop, where the first series loop and the second series loop are connected in parallel.

For example, two resistance wires are wound in the left grip and two resistance wires are wound in the right grip, and the temperature control module is configured to heat the left grip or the right grip by outputting a current to the preceding two resistance wires. The preceding two resistance wires may be wound in the left grip or the right grip through double-wire winding.

In an illustrative example, a third resistance wire is wound in the handle assembly and passes through the left grip and the right grip.

For example, a slot is disposed on each of the left grip and the right grip, and the third resistance wire may be embedded in the slot. In the examples of the present application, the handle assembly may be heated through one resistance wire. In this case, the handle assembly may include only one temperature switch, and the temperature switch may be disposed in the left grip, the right grip, or the connection portion (the connection portion is configured to connect the left grip to the right grip), which is not limited in the examples of the present application. One end of the third resistance wire is coupled to the temperature switch, and the other end of the third resistance wire is coupled to the temperature control module. The temperature switch is in the off state in the case where the temperature of the left grip/the connection portion/the right grip is higher than the first threshold, and the temperature switch is in the on state in the case where the temperature of the left grip/the connection portion/the right grip is lower than the second threshold.

It is to be noted that undisclosed technical details of the handle assembly described in the preceding example may be found in the description of the example of a handle system in the example described below.

Figure 2:
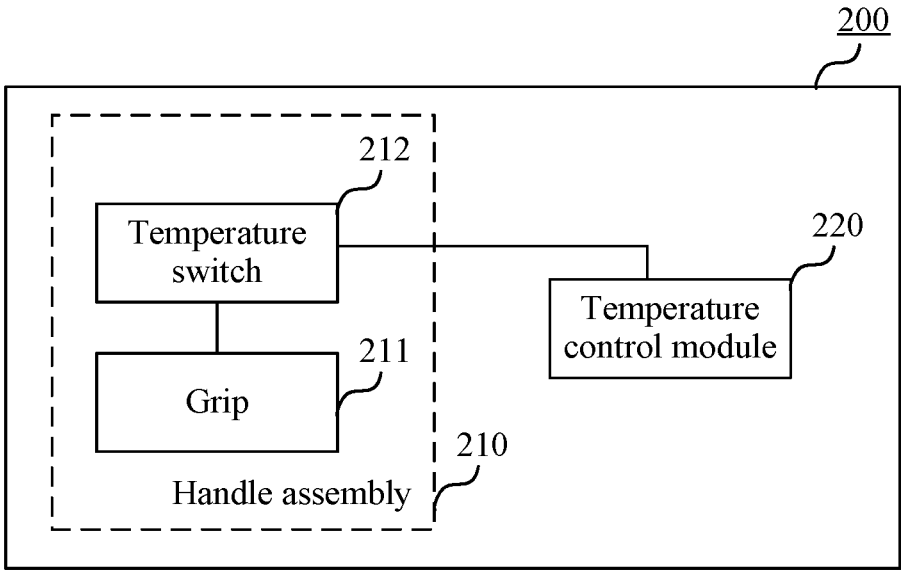
FIG. 2 is a schematic diagram of a handle system applicable to a power tool according to an example of the present application.

Referring to FIG. 2, a schematic diagram of a handle system applicable to a power tool according to an example of the present application is shown. A handle system 200 includes a handle assembly 210 and a temperature control module 220.

The handle system provided by the present application is applicable to the power tool, particularly, a power tool which needs to be used in the low-temperature environment. The power tool includes, but is not limited to, the chain saw, the electric drill, the circular saw, the snow thrower, the string trimmer, and the like.

The handle assembly 210 includes a grip 211 and a temperature switch 212.

For example, the handle assembly 210 is configured to be operated by the user. The handle assembly 210 may also be referred to as the handle device, the handle module, or the like, which is not limited in the examples of the present application.

The grip 211 is configured to be held by the user, and the user may operate the power tool by operating the grip 211. For example, when the power tool includes the snow thrower, the user can implement the steering operation of the snow thrower by operating the grip 211.

The temperature control module 220 is coupled to the grip 211.

The temperature control module 220 refers to a module configured to control a heating temperature of the grip 211. For example, the temperature control module 220 may also be referred to as the constant current source module.

The temperature control module 220 is configured to heat the grip 211.

For example, the handle system also includes a signal collection module. The temperature control module receives a working signal from the signal collection module and heats the grip based on the working signal.

For example, the handle system also includes a temperature detection module. In the case where it is determined that the temperature of the grip is lower than a third threshold, the temperature detection module sends a signal to the temperature control module, where the signal is used for instructing the temperature control module to heat the grip. The third threshold may be any threshold, where the third threshold may be equal to, less than, or greater than the second threshold, which is not limited in the examples of the present application.

The manner in which the grip is heated is described below.

The temperature switch 212 is disposed on a heating path from the temperature control module to the grip, the temperature switch 212 is in the off state in the case where the temperature of the grip is higher than the first threshold, and the temperature switch 212 is in the on state in the case where the temperature of the grip is lower than the second threshold.

The temperature switch 212 refers to a switch automatically turning off and on based on the temperature. For example, the temperature switch 212 is disposed in the grip to better determine the temperature of the grip. The temperature switch 212 is disposed in the grip, which may be understood as that a horizontal and/or vertical projection of the temperature switch partially or completely overlaps with a horizontal and/or vertical projection of the grip. It is to be noted that a position where the temperature switch is placed has an effect on a temperature sensed by the temperature switch, that is, the temperature sensed by the temperature switch may not be completely equal to an actual temperature of the grip. However, this error may be ignored in the examples of the present application, and the temperature sensed by the temperature switch is considered as the temperature of the grip.

For example, a resistance wire is wound in the grip, and the temperature control module is configured to heat the grip by outputting a current to the resistance wire. In this case, the temperature control module, the temperature switch, and the resistance wire constitute a closed loop. The resistance wire is wound in the grip, which may be understood as that multiple slots are disposed on the grip, and the resistance wire may be embedded in the preceding multiple slots. For example, the grip has a cylindrical shape, a steel tube is in the grip, the steel tube is sleeved with plastic which may be hard rubber, the resistance wire is wound outside the plastic, an outer layer of the resistance wire is covered by a thermally insulated thermoplastic elastomer (TPE), and the resistance wire may be wound on the plastic in a serpentine manner or may be helically wound on the plastic, where a winding manner of the resistance wire is not limited in the examples of the present application.

For example, a fourth resistance wire is wound in the grip, and the temperature control module is configured to heat the grip by outputting a current to the fourth resistance wire. The preceding fourth resistance wire may be any resistance wire. One end of the fourth resistance wire is coupled to the temperature switch, and the other end of the fourth resistance wire is coupled to the temperature control module. The temperature switch, the fourth resistance wire, and the temperature control module constitute a loop. The fourth resistance wire is wound in the grip through the single-wire winding. For example, the temperature switch includes a first terminal and a second terminal, where the first terminal of the temperature switch is coupled to one end of the fourth resistance wire, the other end of the fourth resistance wire is coupled to the temperature control module, and the temperature control module is further coupled to the second terminal of the temperature switch, thereby forming a closed loop. For example, the temperature switch may be coupled to the fourth resistance wire through a first connection terminal, and the fourth resistance wire may be coupled to the temperature control module through a second connection terminal.

For example, a fifth resistance wire and a sixth resistance wire are wound in the grip. One end of the fifth resistance wire and one end of the sixth resistance wire is coupled to the temperature switch, the other end of the fifth resistance wire and the other end of the sixth resistance wire is coupled to the temperature control module, and the temperature control module, the fifth resistance wire, the temperature switch, and the sixth resistance wire form a closed loop. The temperature control module is configured to heat the grip by outputting a current to the fifth resistance wire and the sixth resistance wire. The fifth resistance wire may be any resistance wire, and the sixth resistance wire may be any resistance wire. The fifth resistance wire and the sixth resistance wire are two resistance wires and may have the same length or different lengths, which is not limited in the examples of the present application. The temperature switch is disposed on the same side of the fifth resistance wire and the sixth resistance wire, and the temperature control module is disposed on the same side of the fifth resistance wire and the sixth resistance wire. The fifth resistance wire and the sixth resistance wire are wound in the grip through the double-wire winding. For example, the temperature switch includes the first terminal and the second terminal, where the first terminal of the temperature switch is coupled to one end of the fifth resistance wire, the second terminal of the temperature switch is coupled to one end of the sixth resistance wire, the other end of the fifth resistance wire is coupled to the temperature control module, and the other end of the sixth resistance wire is coupled to the temperature control module. Two resistance wires are configured to be wound in the grip, which can facilitate the arrangement of the temperature switch in a proper position in a heated region of the grip. Thus, it is convenient for the temperature switch to sense the temperature of the grip.

It is to be noted that in the examples of the present application, examples in which only one resistance wire and two resistance wires are wound on the grip are used for description. In other possible implementations, three or more resistance wires may be wound on the grip, which is not limited in the examples of the present application.

For example, the grip and the temperature switch may be integrally designed, that is, the grip and the temperature switch may be used as a whole.

For example, in the process where the temperature control module heats the grip until the temperature of the grip reaches the first threshold, the temperature switch is in the on state; in the case where the temperature of the grip is higher than the first threshold, the temperature switch is in the off state, and the temperature control module stops heating the grip; after the temperature control module stops heating the grip, the temperature of the grip gradually decreases, and in the process where the temperature of the grip decreases from the first threshold to the second threshold, the temperature switch is in the off state, and the heating path from the temperature control module to the grip is off; and in the case where the temperature of the grip is lower than the second threshold, the temperature switch is in the on state again, and the temperature control module heats the grip again.

For example, the first threshold includes 60° C. and the second threshold includes 45° C. In this case, the temperature switch is in the off state in the case where the temperature of the grip is higher than 60° C., and the temperature switch is in the on state in the case where the temperature of the grip is lower than 45° C. The temperature switch is disposed on the heating path from the temperature control module to the grip, which can maintain the temperature of the grip between the first threshold and the second threshold, thereby forming closed-loop constant-temperature control. In the case where the temperature of the grip is higher than the first threshold, the temperature switch is in the off state, the heating path from the temperature control module to the grip is off, and the temperature control module cannot continue heating the grip, which can avoid, to a certain extent, unnecessary waste of resources due to continuous heating and the risk that the operator cannot operate the power tool comfortably due to an excessively high temperature; and in the case where the temperature of the grip is lower than the second threshold, the temperature switch is in the on state, the heating path from the temperature control module to the grip is on, and the temperature control module heats the grip so that the grip can be automatically heated when the temperature of the grip is relatively low, which can avoid, to a certain extent, the risk that the operator cannot operate the power tool comfortably due to the relatively low temperature. Since the temperature switch can automatically turn off and on based on the temperature of the grip, automatic heating is implemented when the temperature is relatively low, and heating is automatically stopped when the temperature is relatively high, which provides the operator with the comfortable working environment and improves the resource utilization efficiency (for example, power and an electric quantity) of the power tool.

It is to be noted that values of the preceding first threshold and the preceding second threshold are only exemplary. In practical application, the first threshold and the second threshold may be set according to requirements, and the values of the first threshold and the second threshold are not limited in the examples of the present application. For example, the first threshold may be a value less than or equal to 60° C., and the second threshold may be a value greater than or equal to 35° C.

For example, the heated region of the grip exhibits a first color in the case where the temperature of the grip is lower than the third threshold, and the heated region of the grip exhibits a second color in the case where the temperature of the grip is higher than the third threshold.

The heated region of the grip refers to a region in which the resistance wire is disposed, that is, a region of the grip through which an output current of the temperature control module flows.

For example, the heated region of the grip is made of a special material which exhibits the first color when the sensed temperature is lower than the third threshold and exhibits the second color when the sensed temperature is higher than the third threshold, where the first color and the second color are two different colors. The third threshold may be any value, and the third threshold may be equal to the second threshold or the first threshold. Of course, in other possible implementations, the third threshold may be unequal to the second threshold or the first threshold, which is not limited in the examples of the present application. In the examples of the present application, the heated region of the grip exhibits different colors when the temperature of the grip is lower and higher than the third threshold so that it is convenient for the user to feel a temperature change more intuitively.

For example, the heated region of the grip exhibits a third color in the case where the temperature of the grip is lower than a fourth threshold, the heated region of the grip exhibits a fourth color in the case where the temperature of the grip is higher than the fourth threshold and lower than a fifth threshold, and the heated region of the grip exhibits a fifth color in the case where the temperature of the grip is higher than the fifth threshold.

For example, the heated region of the grip is made of a special material which exhibits the third color when the sensed temperature is lower than the fourth threshold, exhibits the fourth color when the sensed temperature is higher than the fourth threshold and lower than the fifth threshold, and exhibits the fifth color when the sensed temperature is higher than the fifth threshold. The third color, the fourth color, and the fifth color are different colors from each other. The fourth threshold may be any value, and the fifth threshold may be any value, where the fourth threshold is less than the fifth threshold. For example, the fourth threshold is equal to the second threshold, and the fifth threshold is equal to the first threshold. Of course, in other possible implementations, the fourth threshold may be unequal to the second threshold, and the fifth threshold may be unequal to the first threshold, which is not limited in the examples of the present application. In the examples of the present application, the heated region of the grip exhibits different colors when the temperature of the grip is in different temperature intervals so that it is convenient for the user to feel the temperature change more intuitively.

For example, the preceding special material may be used in all regions of the grip which are not limited to the heated region of the grip, which is not limited in the examples of the present application.

Figure 3:
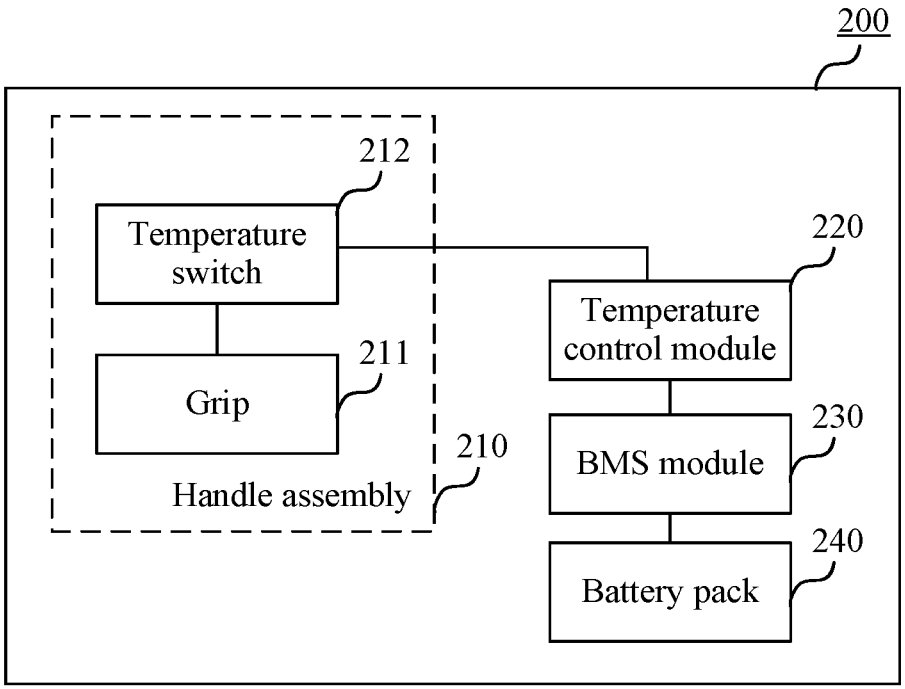
FIG. 3 is a schematic diagram of a handle system applicable to a power tool according to another example of the present application.

In an illustrative example, as shown in FIG. 3, the power tool further includes a battery management system (BMS) module 230 and a battery pack 240, where the BMS module 230 is coupled to the temperature control module 220 and the battery pack 240 separately. The BMS module 230 outputs +56 V directly to the temperature control module 220, and the temperature control module 220 heats the grip 211 based on the working signal and the 56 V voltage.

In summary, in the technical solution provided by the examples of the present application, the temperature control module heats the handle assembly. Since the grip is the part which the operator needs to hold, the temperature of the grip affects the user experience of the operator. The grip is heated so that the part held by the operator has the relatively high temperature, thereby providing the operator with the comfortable working environment in the low-temperature environment.

In addition, the temperature switch is disposed on the heating path from the temperature control module to the grip, the temperature switch is in the off state in the case where the temperature of the grip is higher than the first threshold, and the temperature switch is in the on state in the case where the temperature of the grip is lower than the second threshold so that the temperature of the grip is in a constant temperature state, which further ensures that the operator is provided with a good working environment.

Figure 4:
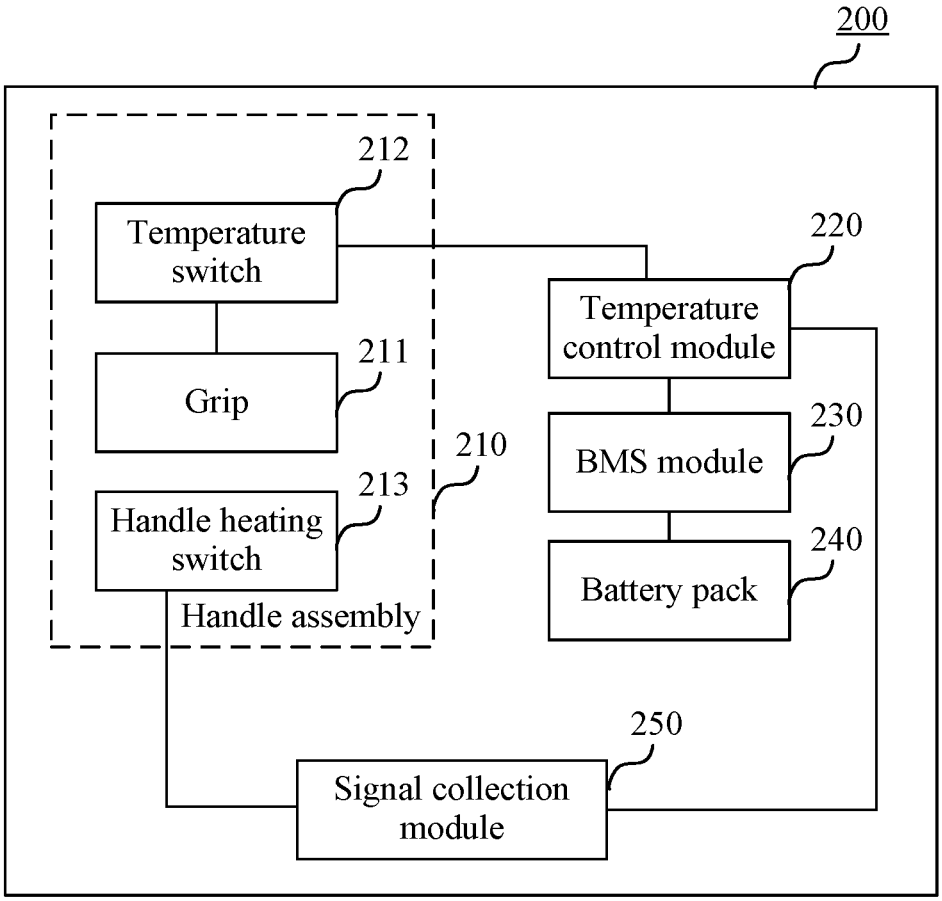
FIG. 4 is a schematic diagram of a handle system applicable to a power tool according to another example of the present application.

Referring to FIG. 4, a schematic diagram of a handle system applicable to a power tool according to an example of the present application is shown. The handle system 200 includes the handle assembly 210, the temperature control module 220, and a signal collection module 250.

The handle assembly 210 includes the grip 211, the temperature switch 212, and a handle heating switch 213. The handle heating switch 213 is configured to enable and disable a handle heating function.

The handle heating switch 213 may be disposed on the handle assembly 210, and the user may operate the handle heating switch 213 to enable and disable the handle heating function. The handle heating function refers to the function of heating the grip 211. For example, the handle heating switch 213 includes a long-closed switch, where an on state of the normally-closed switch corresponds to disabling the handle heating function, and an off state of the normally-closed switch corresponds to enabling the handle heating function. For example, the handle heating switch 213 includes a push-button switch, where an on state of the push-button switch corresponds to enabling the handle heating function, and an off state of the push-button switch corresponds to disabling the handle heating function. For example, the handle heating switch 213 includes a slide switch, where an on state of the slide switch corresponds to enabling the handle heating function, and an off state of the slide switch corresponds to disabling the handle heating function. It is to be noted that the functional modes corresponding to the preceding switch states are only exemplary and may be changed according to the design of a developer in practical application, which is not limited in the examples of the present application. Of course, in other possible implementations, the handle heating switch 213 may include other types of switches, which is not limited in the examples of the present application.

For example, the handle heating switch 213 may be disposed on the grip 211, or the handle heating switch 213 and the grip 211 may be disposed independently, that is, the handle heating switch 213 may be disposed in another position of the power tool where it is convenient for the user to operate the handle heating switch 213. The position where the handle heating switch 213 is disposed is not limited in the examples of the present application.

The signal collection module 250 is coupled to the handle heating switch 213 and the temperature control module 220 separately, and the temperature control module 220 is coupled to the grip 211.

The signal collection module 250 refers to a module configured to collect signals.

The signal collection module 250 is configured to collect an operation signal of the handle heating switch 213 and in the case where the operation signal is a function enabling signal, send the working signal to the temperature control module 220.

The signal collection module 250 is coupled to the handle heating switch 213, and the signal collection module 250 may be connected to the handle heating switch 213 through electrical coupling. The signal collection module 250 may be configured to collect the operation signal of the user for the handle heating switch 213. The operation signal of the handle heating switch 213 includes the function enabling signal and a function disabling signal, where the function enabling signal is used for instructing the handle heating function to be enabled, and the function disabling signal is used for instructing the handle heating function to be disabled. The signal collection module 250 is configured to send the working signal to the temperature control module 220 in the case where the operation signal is the function enabling signal, where the working signal is used for instructing the temperature control module 220 to work.

The temperature control module 220 is configured to heat the grip 211 based on the working signal.

After receiving the working signal from the signal collection module 250, the temperature control module 220 heats the grip 211 based on the working signal. For example, the temperature control module 220 is configured to output a current to the grip 211 based on the working signal to heat the grip 211. The manner in which the grip 211 is heated is described below.

The temperature switch 212 is disposed on the heating path from the temperature control module 220 to the grip 211, the temperature switch 212 is in the off state in the case where the temperature of the grip 211 is higher than the first threshold, and the temperature switch 212 is in the on state in the case where the temperature of the grip 211 is lower than the second threshold.

The temperature switch 212 refers to the switch automatically turning off and on based on the temperature. For example, the temperature switch 212 is disposed in the grip 211 to better determine the temperature of the grip 211. The temperature switch 212 is disposed in the grip 211, which may be understood that a horizontal and/or vertical projection of the temperature switch 212 partially or completely overlaps with a horizontal and/or vertical projection of the grip 211. It is to be noted that the position where the temperature switch is placed has an effect on the temperature sensed by the temperature switch, that is, the temperature sensed by the temperature switch may not be completely equal to the actual temperature of the grip. However, this error may be ignored in the examples of the present application, and the temperature sensed by the temperature switch is considered as the temperature of the grip.

For example, the handle assembly also includes a function indicating assembly. The function indicating assembly is configured to indicate enabled and disabled states of the handle heating function. For example, the function indicating assembly includes a light-emitting diode (LED) light, where in the case where the handle heating function is enabled, the LED light is on, and in the case where the handle heating function is disabled, the LED light is off. Of course, in other possible implementations, the function indicating assembly may include a display panel assembly. In the case where the handle heating function is enabled, a first text is displayed on the display panel assembly and used for indicating that the handle heating function is enabled; and in the case where the handle heating function is disabled, a second text is displayed on the display panel assembly and used for indicating that the handle heating function is disabled. Alternatively, in the case where the handle heating function is enabled, a text is displayed on the display panel assembly and used for indicating that the handle heating function is enabled; and in the case where the handle heating function is disabled, the preceding text is not displayed on the display panel assembly. Of course, in other possible implementations, the function indicating assembly may include other types of assemblies for indicating the enabled and disabled states of the handle heating function, which is not limited in the examples of the present application.

The manner in which the grip is heated is described below.

In an illustrative example, the signal collection module 250 is configured to send the working signal to the temperature control module 220 in the case where the operation signal is the function enabling signal, where the working signal includes a first output signal for indicating that heating is performed with a first output parameter.

For example, the first output parameter is a maximum output parameter. An example in which the output parameter is the current is used for description, where the first output parameter may be 2.5 A (amperes). In this manner, in the case where the signal collection module collects the function enabling signal, the temperature control module is instructed to heat the grip with the first output parameter so that the temperature of the grip is quickly increased in a relatively short time to reach the first threshold, thereby quickly providing the operator with the comfortable working environment.

It is to be noted that the first output parameter may be set according to actual requirements.

In this case, after receiving the first output signal, the temperature control module 220 heats the grip 211 with the first output parameter all the time, and when the temperature of the grip 211 reaches the first threshold, the temperature switch changes from the on state to the off state and the temperature control module 220 stops heating the grip 211. In this manner, the grip 211 can be heated quickly with a good heating effect.

Figure 5:
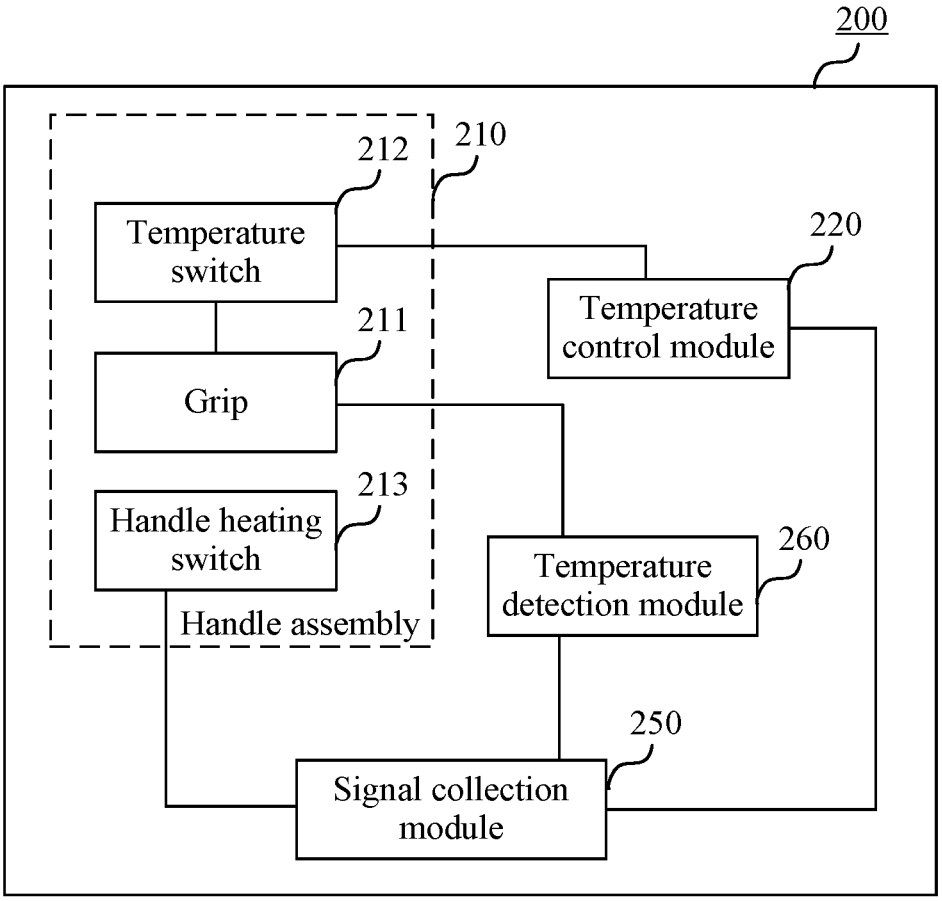
FIG. 5 is a schematic diagram of a handle system applicable to a power tool according to another example of the present application.

For example, as shown in FIG. 5, the handle system 200 further includes a temperature detection module 260.

The temperature detection module 260 refers to a module configured to detect the temperature of the grip 211. For example, the temperature detection module 260 includes a negative temperature coefficient (NTC) temperature detection module.

The temperature detection module 260 is coupled to the grip 211 and the signal collection module 250 separately.

The temperature detection module 260 is configured to collect the temperature of the grip 211 and send the temperature of the grip 211 to the signal collection module 250.

For example, the temperature detection module 260 may be disposed in the grip 211 to be configured to collect the temperature of the grip 211. After collecting the temperature of the grip 211, the temperature detection module 260 sends the temperature of the grip 211 to the signal collection module 250. For example, the temperature detection module 260 may collect the temperature of the grip 211 every preset time. The preset time may be a default time, for example, 10 seconds, 15 seconds, or another time. Alternatively, the preset time may be personalized by the operator. For example, a time setting assembly is disposed on the power tool, and the operator may set the preceding preset time through the time setting assembly, which is not limited in the examples of the present application.

The signal collection module 250 is further configured to adjust the first output signal to a second output signal in the case where the temperature of the grip 211 reaches a preset temperature, where the second output signal is used for indicating that the heating is performed with a second output parameter, and the first output parameter is greater than the second output parameter.

For example, the preset temperature is lower than the first threshold and higher than the second threshold. In the case where the temperature of the grip 211 reaches the preset temperature, the signal collection module 250 sends the second output signal to the temperature control module 220, that is, the working signal is adjusted from the first output signal to the second output signal. When the temperature of the grip 211 reaches the preset temperature, it indicates that the temperature of the grip 211 reaches a temperature which makes the operator comfortable. In this case, the first output signal may be adjusted to the second output signal so that the power of the power tool is reduced, thereby prolonging the use time of the power tool.

Typically, the first output parameter and the second output parameter are both positive numbers.

In this case, the temperature control module 220 heats the grip with the first output parameter until the temperature of the grip reaches the preset temperature; and after the temperature of the grip reaches the preset temperature, the temperature control module 220 heats the grip 211 with the second output parameter. In this manner, the power of the power tool can be reduced, thereby prolonging the use time of the power tool.

In an illustrative example, the handle system 200 further includes the temperature detection module 260.

The temperature detection module 260 is coupled to the grip 211 and the signal collection module 250 separately.

The temperature detection module 260 is configured to collect the temperature of the grip 211 and send the temperature of the grip to the signal collection module 250.

The signal collection module 250 is further configured to send a third output signal to the temperature control module based on the temperature of the grip 211, where the third output signal is used for indicating that the heating is performed with a third output parameter.

The temperature control module 220 is further configured to heat the grip based on the third output signal.

In this manner, the signal collection module 250 outputs the third output signal to the temperature control module 220 based on the temperature of the grip 211 so that the temperature control module 220 heats the grip 211 based on the temperature of the grip 211. The temperature detection module 260 collects the temperature of the grip 211 every preset time. The preset time may be 5 seconds, 10 seconds, or another time. The length of the preset time is not limited in the examples of the present application.

For example, in the case where the operation signal of the handle heating switch collected by the signal collection module 250 is the function enabling signal, the signal collection module 250 reads the temperature of the grip 211 collected by the temperature detection module 260 and determines the third output signal based on the temperature of the grip 211. Then, the temperature control module 220 heats the grip 211 with the third output parameter all the time, that is, the third output parameter is fixed.

For example, in the case where the operation signal of the handle heating switch collected by the signal collection module 250 is the function enabling signal, the signal collection module 250 reads the temperature of the grip 211 collected by the temperature detection module 260 and determines the third output signal based on the temperature of the grip 211 collected at this time. After the preset time, the signal collection module 250 reads again the temperature of the grip 211 collected by the temperature detection module 260 and determines an updated third output signal based on the temperature of the grip 211 collected at this time. That is, the third output parameter is varied. The preset time may be set according to the actual requirements. Generally, the preset time is shorter than a time required to heat the grip to the first threshold with the first output parameter.

For example, the third output signal includes a pulse-width modulation (PWM) signal. In this case, the grip 211 may be heated in the manner described below. The signal collection module 250 is configured to determine, based on a stored preset correspondence, a PWM signal corresponding to the temperature of the grip and send the PWM signal to the temperature control module; where the preset correspondence includes at least one correspondence between the temperature and the PWM signal.

For example, the preset correspondence may be stored in the signal collection module 250.

For example, the PWM signal may include a current signal, and the at least one correspondence between the temperature and the PWM signal may be as follows: the temperature is from 20° C. to 30° C. and the PWM signal is used for indicating that the heating is performed at a current of 1.05 A to 1.1 A; the temperature is from 10° C. to 20° C. and the PWM signal is used for indicating that the heating is performed at a current of 1.35 A to 1.4 A; the temperature is from 0° C. to 10° C. and the PWM signal is used for indicating that the heating is performed at a current of 1.85 A to 1.9 A; the temperature is from −10° C. to 0° C. and the PWM signal is used for indicating that the heating is performed at a current of 2.15 A to 2.2 A; the temperature is from −20° C. to −10° C. and the PWM signal is used for indicating that the heating is performed at a current of 2.3 A to 2.35 A; and the temperature is below −20° C. and the PWM signal is used for indicating that the heating is performed at a current of 2.45 A to 2.5 A.

It is to be noted that the preceding preset correspondence is only exemplary, and the preset correspondence may be set by the developer according to requirements in practical application.

The temperature control module 220 is further configured to heat the grip based on the PWM signal.

In this manner, the signal collection module 250 determines the third output signal based on the temperature of the grip 211 so that the temperature control module 220 heats the grip 211 based on the third output signal. The signal collection module 250 may determine, according to the temperature of the grip 211, an output parameter corresponding to a current temperature so as to heat the grip 211. The output parameter is determined based on the temperature of the grip 211 so that the output parameter is determined with diversity and more in accordance with the current temperature, thereby avoiding the case where when the temperature of the grip is relatively low, the grip is heated for a relatively long time with a relatively small output parameter.

Figure 6:
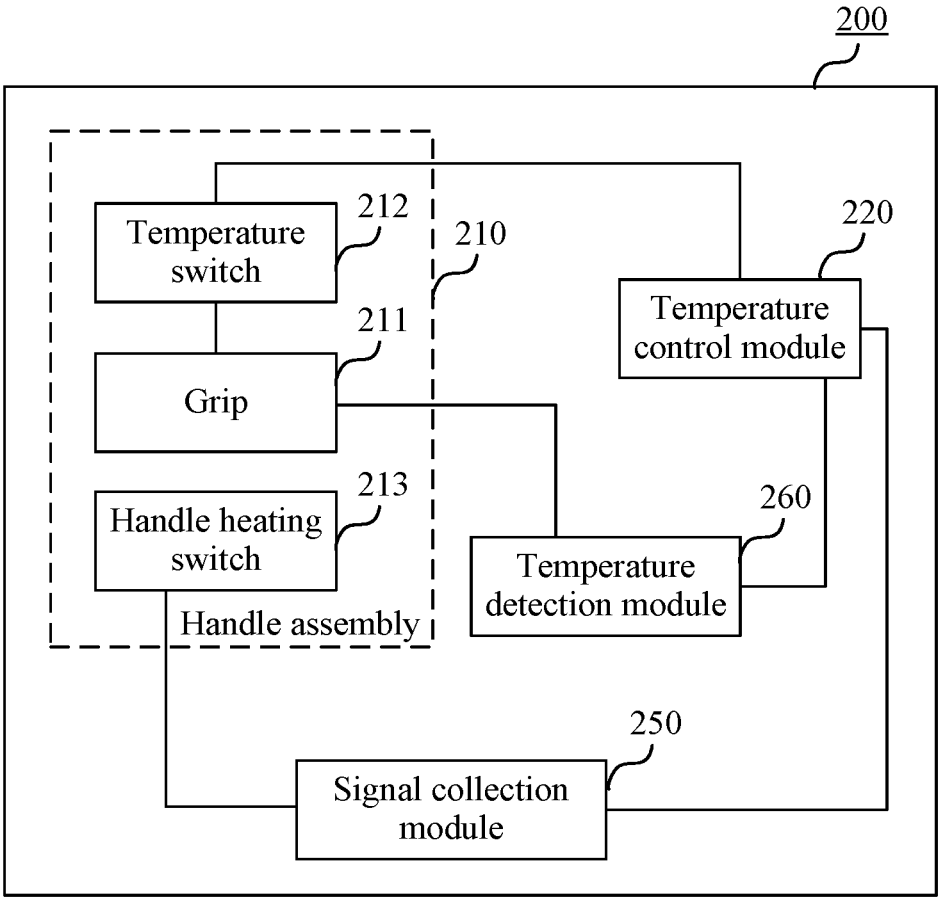
FIG. 6 is a schematic diagram of a handle system applicable to a power tool according to another example of the present application.

In an illustrative example, as shown in FIG. 6, the handle system 200 further includes the temperature detection module 260.

The temperature detection module 260 is coupled to the grip 211 and the temperature control module 220 separately.

The temperature detection module 260 is configured to collect the temperature of the grip 211 and output a voltage based on the temperature of the grip 211.

The voltage of the temperature detection module 260 varies with the temperature of the grip 211. The voltage of the temperature detection module 260 may be understood as a voltage corresponding to an NTC resistor. The temperature detection module 260 includes an NTC resistor and a voltage divider resistor. The voltage corresponding to the NTC resistor varies with the temperature of the grip 211. For example, a resistance value of the voltage divider resistor needs to be set according to an NTC characteristic curve of the NTC resistor.

The temperature control module 220 is configured to determine a fourth output parameter based on the voltage and heat the grip with the fourth output parameter.

The temperature control module 220 determines the fourth output parameter based on the voltage of the NTC resistor. For example, the temperature control module 220 stores at least one correspondence between the voltage and the output parameter, and the temperature control module 220 determines, based on the preceding correspondence, an output parameter corresponding to the voltage of the NTC resistor and determines the output parameter corresponding to the voltage of the NTC resistor to be the fourth output parameter.

Several manners in which the heating of the grip is stopped are described below.

In an illustrative example, the signal collection module 250 is further configured to, in the case where the operation signal is the function disabling signal, send a working stopping signal to the temperature control module 220.

The function disabling signal is used for instructing the handle heating function to be disabled. The working stopping signal is used for instructing the temperature control module 220 to stop working.

For example, the function disabling signal may be triggered by the user, and the user may disable the handle heating function by operating the handle heating switch 213, thereby triggering the signal collection module 250 to collect the function disabling signal.

The temperature control module 220 is further configured to stop heating the grip 211 in the case where the working stopping signal is received.

In the case where the temperature control module 220 receives the working stopping signal, the heating of the grip is stopped regardless of the temperature of the grip 211.

Figure 7:
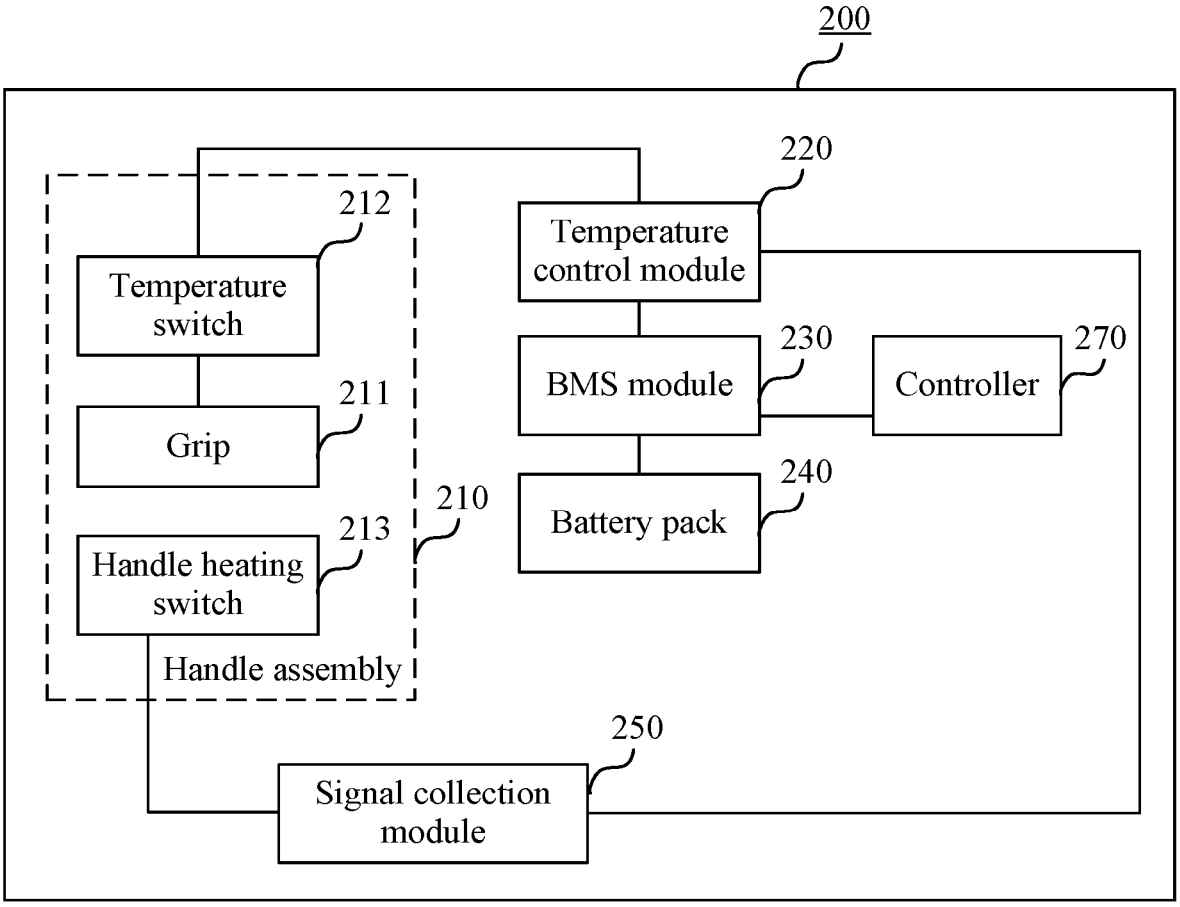
FIG. 7 is a schematic diagram of a handle system applicable to a power tool according to another example of the present application.

In an illustrative example, as shown in FIG. 7, the handle system 200 further includes a controller 270.

The controller 270 is configured to stop the output of the power supply in the case where no operation signal from another circuit is received within a preset period so that the temperature control module 220 stops heating the grip 211.

For example, the power supply refers to the BMS module.

The preset period may be 5 minutes. Of course, in other possible implementations, the preset period may be another period, which is not limited in the examples of the present application.

The operation signal of another circuit refers to an operation signal of another working circuit which needs to be powered by the battery pack, including, but not limited to, any one of an operation signal of a working circuit of the LED light, an operation signal of a working circuit of the body of the power tool, and an operation signal of a self-walking working circuit.

In the case where no operation signal from another circuit is received within the preset period, the controller 270 automatically controls the whole machine to be powered off, that is, the power supply stops the output, and the temperature control module 220 does not have a power supply input, thereby stopping heating the grip 211. In the case where the controller receives no operation signal from another circuit within the preset period, it indicates that the power tool is likely to stop working. In this case, to reduce the power consumption of the power tool, the output of the power supply may be stopped. After the output of the power supply is stopped, the temperature control module 220 also stops heating the grip 211.

Figure 8:
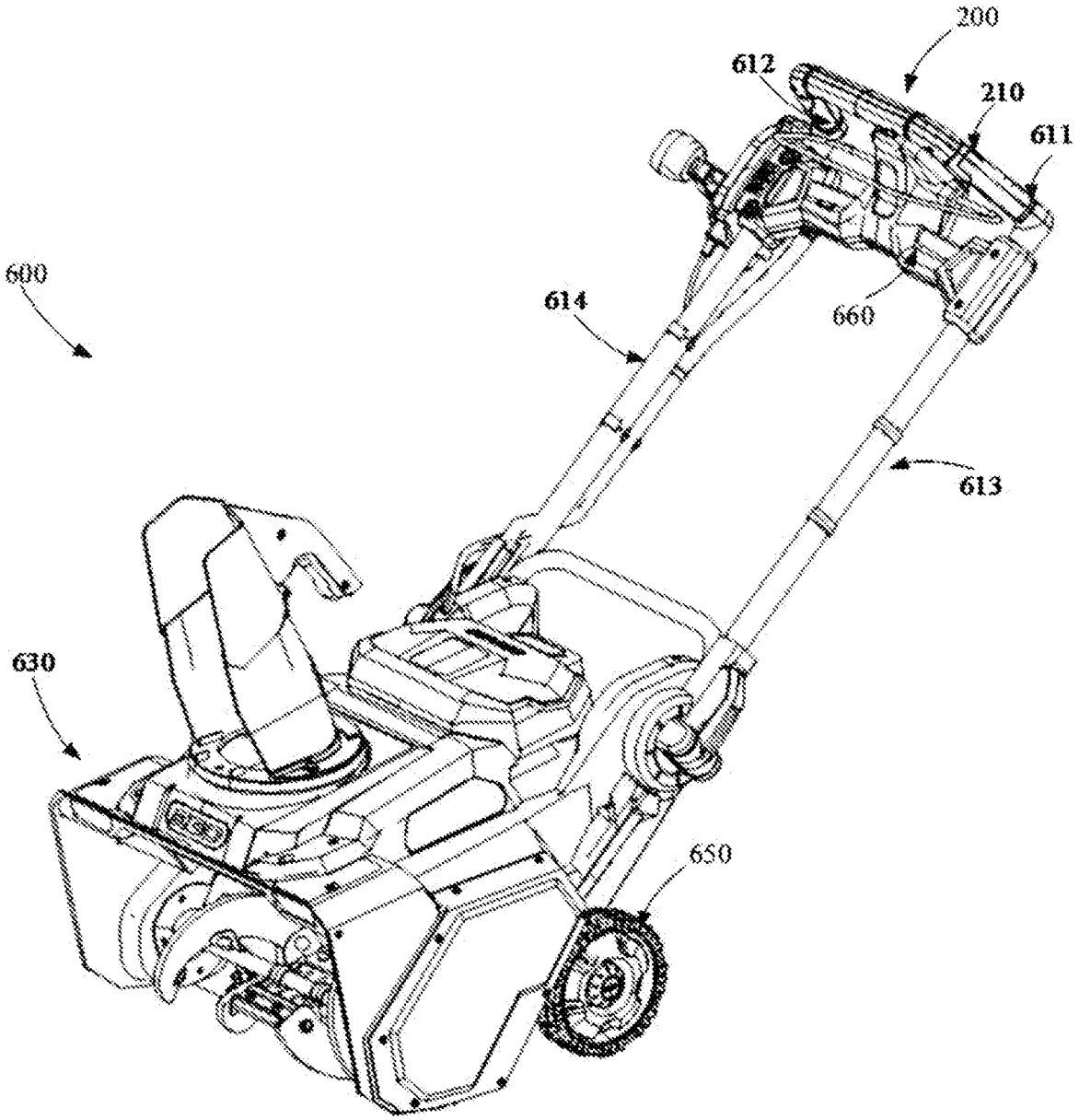
FIG. 8 is a side view of a snow thrower according to an example of the present application.

Referring to FIG. 8, a schematic view of a snow thrower according to an example of the present application is shown. A snow thrower 600 includes the handle system 200 as described in any one of the preceding examples.

Figure 9:
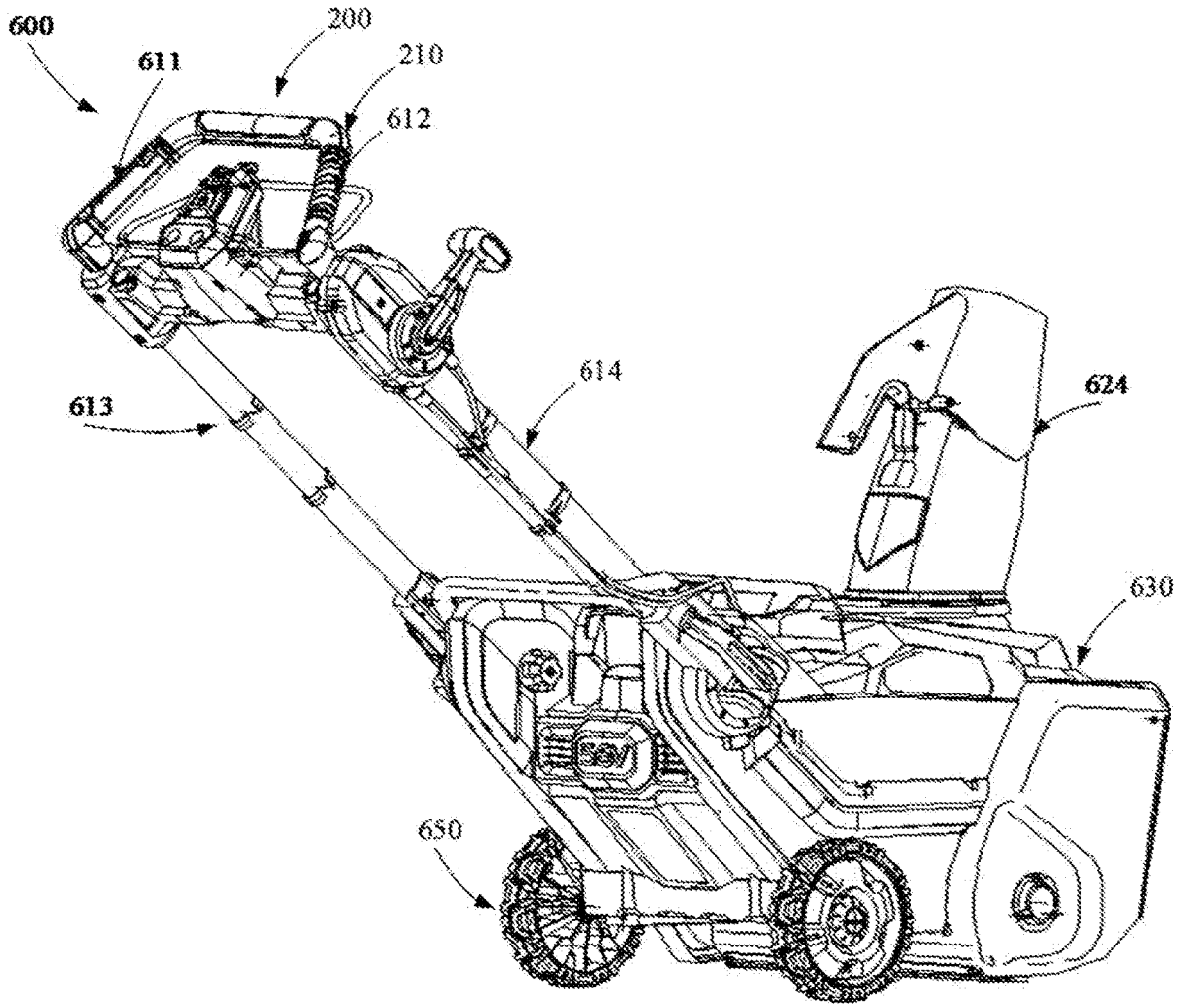
FIG. 9 is a side view of a snow thrower according to another example of the present application.

In the case where the power tool is the snow thrower, as shown in FIG. 9, the snow thrower 600 may include two grips: a left grip 611 and a right grip 612. The left grip 611 refers to a part disposed on a left side of the snow thrower and held by the user, and the right grip 612 refers to a part disposed on a right side of the snow thrower and held by the user. For example, the left grip 611 is held by the left hand of the user, and the right grip 612 is held by the right hand of the user. A temperature switch (not shown in the figure) includes a third temperature switch and a fourth temperature switch. The third temperature switch is disposed on a heating path from a temperature control module to the left grip, the third temperature switch is configured to be in an off state in the case where a temperature of the left grip is higher than a first threshold, and the third temperature switch is configured to be in an on state in the case where a temperature of a left grip is lower than a second threshold. The fourth temperature switch is disposed on a heating path from the temperature control module to the right grip, the fourth temperature switch is configured to be in the off state in the case where a temperature of the right grip is higher than the first threshold, and the fourth temperature switch is configured to be in the on state in the case where the temperature of the right grip is lower than the second threshold.

For example, a current is output from the temperature control module and flows through the left grip, the third temperature switch, the right grip, and the fourth temperature switch. The temperature control module, the third temperature switch, the left grip, the right grip, and the fourth temperature switch constitute a series loop. When the temperature of the left grip reaches the first threshold or the temperature of the right grip reaches the first threshold, the preceding series loop is turned off; and when the temperature of the left grip reaches the second threshold and the temperature of the right grip is lower than the second threshold, the preceding series loop is turned on so that the temperatures of the left grip and the right grip are maintained within a certain temperature range.

For example, the temperature control module, the left grip, and the third temperature switch constitute a first series loop, and the temperature control module, the right grip, and the fourth temperature switch constitute a second series loop, where the first series loop and the second series loop are connected in parallel. The off/on state of the third temperature switch does not affect the heating of the right grip by the temperature control module, and the off/on state of the fourth temperature switch does not affect the heating of the left grip by the temperature control module, thereby improving flexibility. For example, the temperature control module, the left grip, and the third temperature switch constitute the first series loop, and the temperature control module, the right grip, and the fourth temperature switch constitute the second series loop, where the first series loop and the second series loop are connected in series. The off/on state of the third temperature switch affects the heating of the right grip by the temperature control module, and the off/on state of the fourth temperature switch affects the heating of the left grip by the temperature control module, thereby improving safety.

The third temperature switch may be the same as or different from a first temperature switch; and the fourth temperature switch may be the same as or different from a second temperature switch.

For example, a seventh resistance wire is wound in the left grip, and the temperature control module is configured to heat the left grip by outputting a current to the seventh resistance wire; and an eighth resistance wire is wound in the right grip, and the temperature control module is configured to heat the right grip by outputting a current to the eighth resistance wire.

The seventh resistance wire is any resistance wire, and the eighth resistance wire is any resistance wire. In some examples, the seventh resistance wire and the eighth resistance wire are two different resistance wires. In some examples, the seventh resistance wire and the eighth resistance wire are two resistance wires of the same specification.

The seventh resistance wire is wound in the left grip, and the eighth resistance wire is wound in the right grip. Multiple slots are disposed on the left grip, and the seventh resistance wire may be embedded in the multiple slots; and multiple slots are disposed on the right grip, and the eighth resistance wire may be embedded in the multiple slots.

One end of the seventh resistance wire is coupled to the third temperature switch, and the other end of the seventh resistance wire is coupled to the temperature control module; and one end of the eighth resistance wire is coupled to the fourth temperature switch, and the other end of the eighth resistance wire is coupled to the temperature control module. The seventh resistance wire may be wound in the left grip through single-wire winding, and the eighth resistance wire may be wound in the right grip through the single-wire winding. For example, the temperature control module, the seventh resistance wire, the third temperature switch, the eighth resistance wire, and the fourth temperature switch constitute a closed loop. For example, the temperature control module, the seventh resistance wire, and the third temperature switch constitute the first series loop, and the temperature control module, the eighth resistance wire, and the fourth temperature switch constitute the second series loop, where the first series loop and the second series loop are connected in parallel.

For example, two resistance wires are wound in the left grip, and the temperature control module is configured to heat the left grip by outputting the current to the two resistance wires; and two resistance wires are wound in the right grip, and the temperature control module is configured to heat the right grip by outputting the current to the two resistance wires.

For example, the handle system may also include a first connecting rod 613 and a second connecting rod 614. For example, the first connecting rod 613 and the second connecting rod 614 constitute telescopic connections to adjust a height of the handle assembly relative to the ground. The first connecting rod 613 and the second connecting rod 614 are connected to two ends of the grip separately. For example, the first connecting rod 613 and the left grip 611 are coupled to each other, and the second connecting rod 614 and the right grip 612 are coupled to each other. For example, the first connecting rod 613 and the second connecting rod 614 have hollow tubular structures made of aluminum. The grip (including the left grip 611 and the right grip 612) is symmetrical about a central plane. For example, the left grip 611, the right grip 612, the first connecting rod 613, and the second connecting rod 614 are symmetrical about the central plane. For example, the whole constituted by the first connecting rod 613, the second connecting rod 614, and the grip (including the left grip 611 and the right grip 612) may be used as one component (for example, the handle assembly).

In an illustrative example, one end of the left grip is coupled to a body of the snow thrower, the other end of the left grip is coupled to one end of the right grip, and the other end of the right grip is coupled to the body of the snow thrower.

For example, the left grip and the right grip may be directly coupled to each other, and the other end of the left grip and the other end of the right grip may be coupled to the body of the snow thrower through connecting rods. Alternatively, the left grip and the right grip may be coupled to each other through a connection portion, and the other end of the left grip and the other end of the right grip may be coupled to the body of the snow thrower through the connecting rods.

In an illustrative example, the handle assembly may include any one of a "U-shaped" handle assembly, a "linear" handle assembly, a "V-shaped" handle assembly, a "W-shaped" handle assembly, and an "O-shaped" handle assembly. The shape of the "U-shaped" handle assembly is similar to "U", the shape of the "linear" handle assembly is similar to a straight line, the shape of the "V-shaped" handle assembly is similar to "V", the shape of the "W-shaped" handle assembly is similar to "W", and the shape of the "O-shaped" handle assembly is similar to "O".

A ninth resistance wire is wound in the handle assembly and passes through the left grip and the right grip.

For example, a slot is disposed on each of the left grip and the right grip, and the ninth resistance wire may be embedded in the slot.

Figure 10:
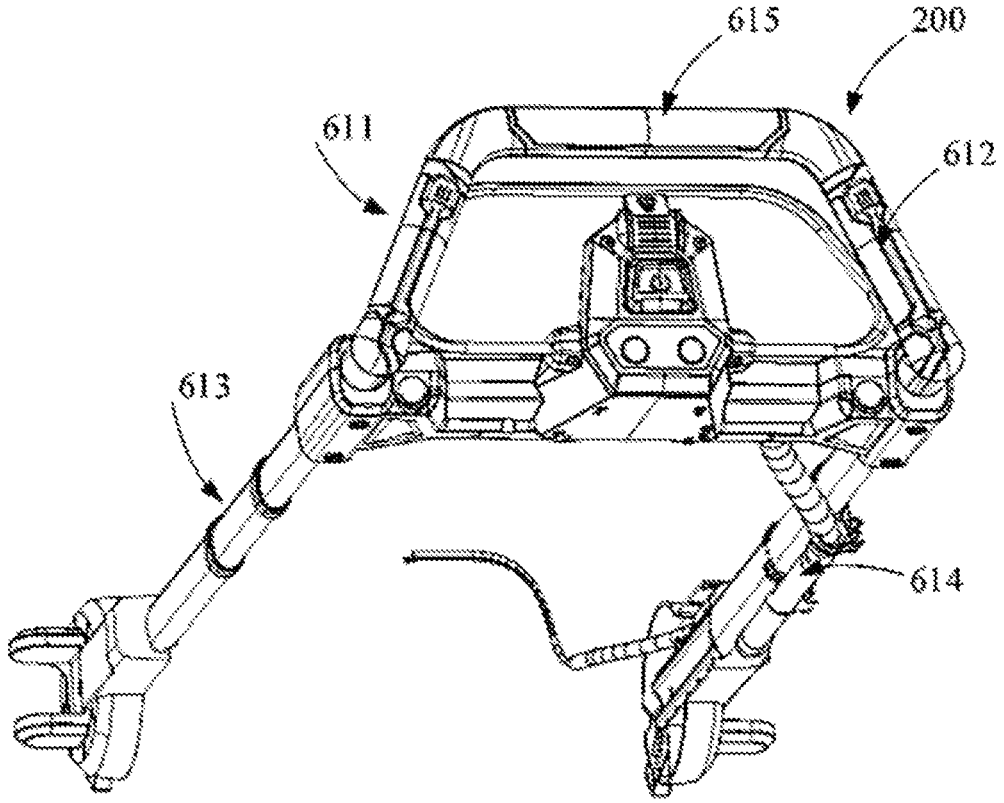
FIG. 10 is a schematic view of a handle system of a snow thrower according to an example of the present application.

For example, as shown in FIG. 10, the handle system 200 further includes a connection portion 615 disposed between the left grip 611 and the right grip 612, and the connection portion 615 is configured to connect the left grip 611 to the right grip 612; and the left grip 611, the connection portion 615, and the right grip 612 constitute a U-shaped handle.

For example, the connection portion 615 may also be held by the user. A material of the connection portion may be the same as that of the left and right grips.

For example, the ninth resistance wire is wound in the U-shaped handle and passes through the left grip, the connection portion, and the right grip. For example, the slot is disposed on each of the left grip, the connection portion, and the right grip, and the ninth resistance wire may be embedded in the slot. In the examples of the present application, the U-shaped handle may be heated through one resistance wire. In this case, the handle assembly may include only one temperature switch, and the temperature switch may be disposed in the left grip, the connection portion, or the right grip, which is not limited in the examples of the present application. One end of the ninth resistance wire is coupled to the temperature switch, and the other end of the ninth resistance wire is coupled to the temperature control module. The temperature switch is in the off state in the case where the temperature of the left grip/the connection portion/the right grip is higher than the first threshold, and the temperature switch is in the on state in the case where the temperature of the left grip/the connection portion/the right grip is lower than the second threshold. The temperature switch may be determined to be in the on/off state based on the temperature of the left grip or the connection portion or the right grip according to a position where the temperature switch is arranged. In the case where the temperature switch is disposed in the left grip, the temperature switch may be in the off/on state based on the temperature of the left grip; in the case where the temperature switch is disposed in the connection portion, the temperature switch may be in the off/on state based on the temperature of the connection portion; and in the case where the temperature switch is disposed in the right grip, the temperature switch may be in the off/on state based on the temperature of the right grip.

Figure 11:
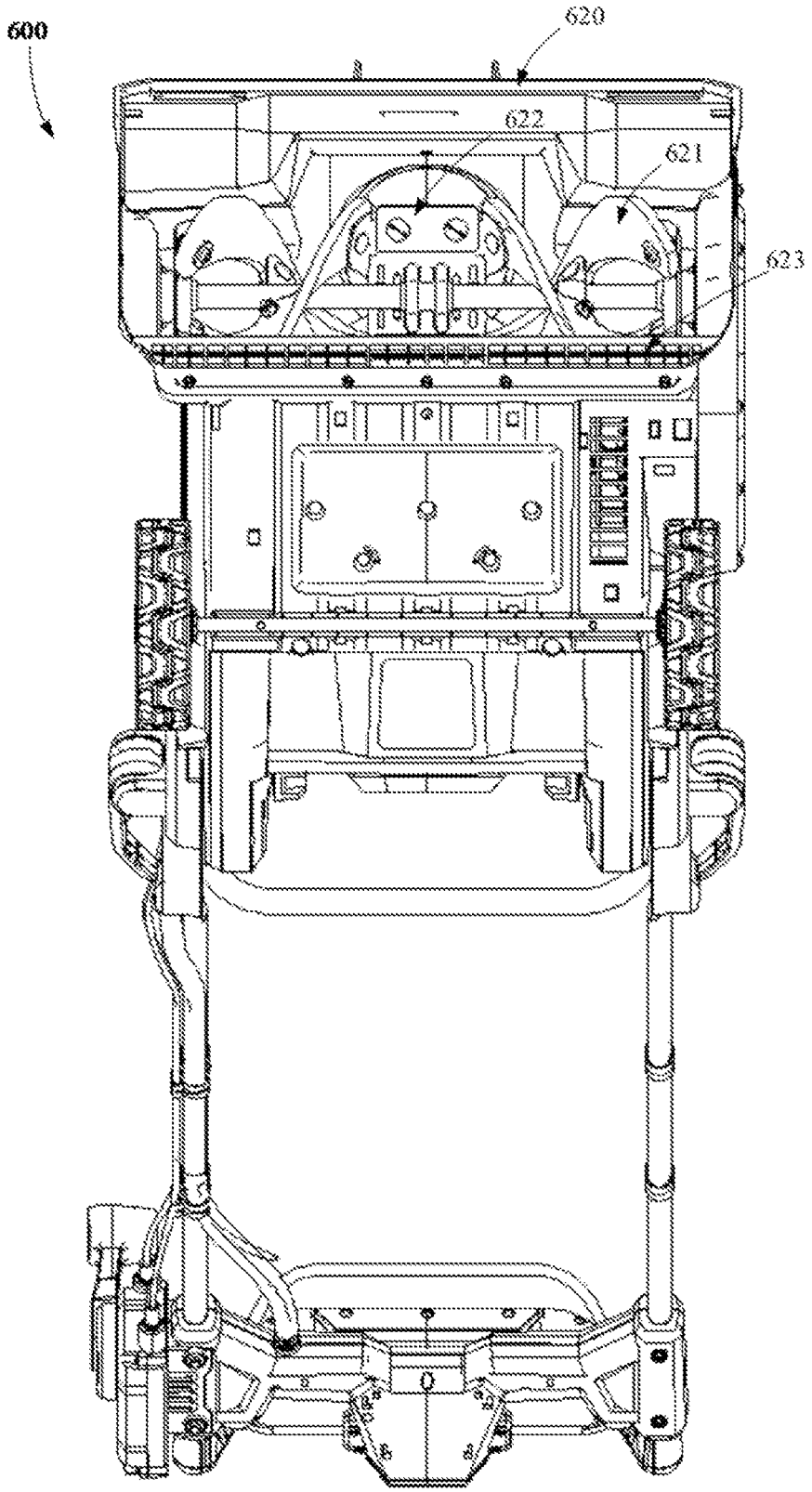
FIG. 11 is a top view of a snow thrower according to an example of the present application.

For example, the snow thrower includes a snow removal system 620 including a snow removal blade 621 and a snow throwing blade 622, as shown in FIG. 11. The snow removal blade 621 is in contact with the ground and the snow throwing blade 622 is not in contact with the ground.

The function of the snow removal blade 621 includes, but is not limited to, at least one of snow removal, snow gathering, and self-walking by rubbing the ground. For example, the snow thrower includes left and right snow removal blade assemblies, each of which includes at least one snow removal blade 621. For example, each snow removal blade 621 may be replaced separately. The snow removal blade 621 may be a rubber blade. For example, a diameter of the snow removal blade 621 is about 10 mm greater than that of the snow throwing blade.

For example, the snow thrower includes the snow throwing blade 622 disposed between the left and right snow removal blade assemblies. The function of the snow throwing blade 622 includes, but is not limited to, at least one of snow stirring and snow throwing. The snow throwing blade 622 is replaceable, and the diameter of the snow throwing blade 622 is about 80 mm.

The snow removal system 620 may also include a deck cavity 623 which has a gap of about 3 mm with the snow removal blade 621 and a gap of about 3 mm with the snow throwing blade 622.

For example, the snow throwing blade 622 and the snow removal blade 621 are disposed independently and may be replaced separately. In some examples, the snow throwing blade 622 and the snow removal blade 621 may be disposed in different positions of the same blade.

For example, the snow removal system 620 also includes a snow throwing device 624 configured to direct snow to a distance or direct the snow to a snow throwing direction of the snow thrower 600.

For example, the snow removal system includes a snow inlet from which the snow enters and a snow outlet from which the snow is discharged out of the cavity. The snow enters the cavity from the snow inlet and is discharged from the snow throwing device 624 after the further action of the snow throwing blade 622.

In the examples of the present application, the snow throwing blade 621 is not in contact with the ground so that a friction loss between the snow throwing blade 621 and the ground can be reduced, and a distance between the snow throwing blade 621 and the deck cavity 623 remains substantially unchanged, thereby ensuring the snow throwing performance of the snow thrower.

For example, the snow thrower 600 may also include a housing assembly 630, a motor 640, and wheels 650.

The housing assembly 630 accommodates or fixes the motor 640. The motor 640 drives the snow thrower 600 to implement a snow removal function. A rotation axis of the motor 640 is parallel to a rotation axis of the snow removal blade. The motor 640 may be an internal combustion engine powered through fuel combustion or an electric motor powered by electricity. For example, the motor is the electric motor, a battery pack is electrically connected to the motor 640 to power the motor 640, and the battery pack is detachably connected to the motor 640. The wheels 650 rotate relative to the housing assembly 630 so that the snow thrower 600 walks on the ground. For example, the wheels 650 may be replaced with tracks so that the snow thrower 600 can walk on the ground.

For example, the snow thrower 600 further includes a switch box 660, and two ends of the switch box 660 are fixedly connected to the first connecting rod and the second connecting rod. A trigger is configured to start the snow thrower 600 to remove the snow, and the trigger is rotatably connected to the switch box 660. A speed regulation switch is configured to adjust a speed. For example, the speed regulation switch may be configured to adjust a rotational speed of the motor 640 or a rotational speed of a wheel 650. The speed regulation switch is rotatably connected to the switch box 660. The speed regulation switch is disposed at one end of the switch box 660, and the speed regulation switch may be disposed near the first connecting rod 613. For example, the speed regulation switch is fixed to the first connecting rod 613 through the switch box 660. Of course, in other possible implementations, the speed regulation switch may be disposed near the second connecting rod 614.

For example, the snow thrower may further include an illumination device configured to illuminate working regions around the snow thrower. The working regions around the snow thrower include at least one of a working region on a front side of the snow thrower, a working region on a rear side of the snow thrower, a working region on the left side of the snow thrower, and a working region on the right side of the snow thrower.

Figure 12:
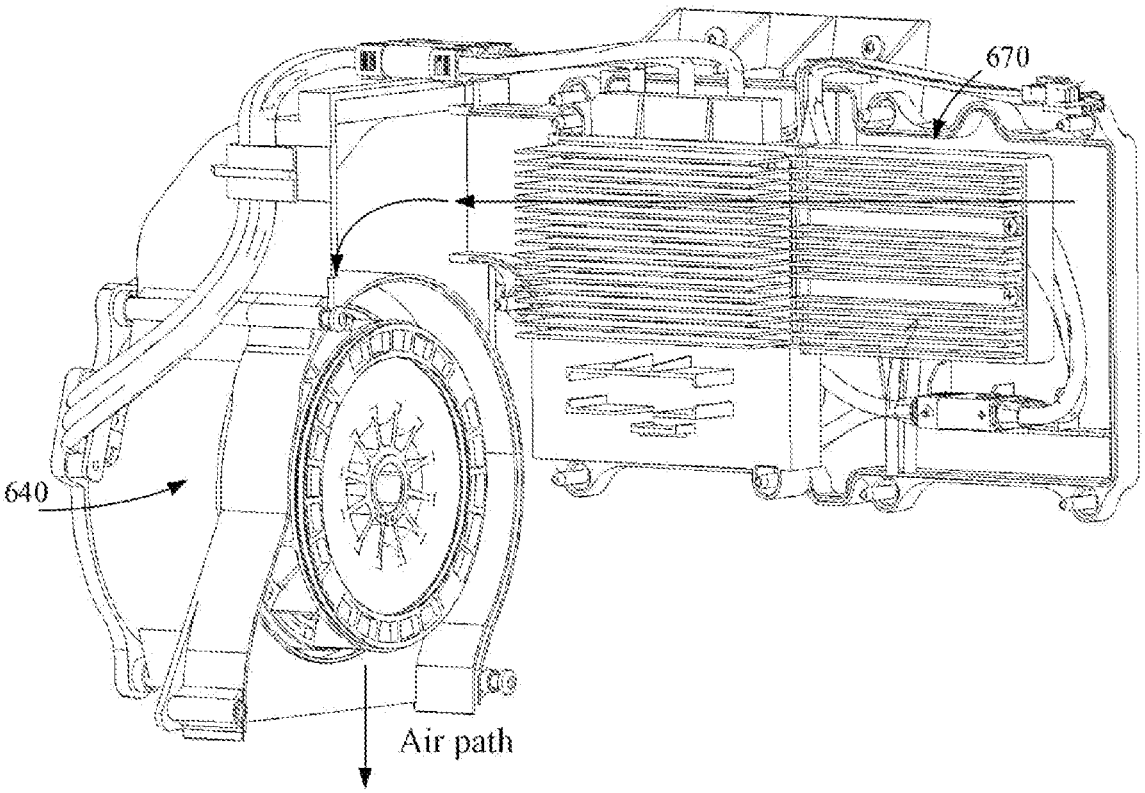
FIG. 12 is a schematic view of an air path according to an example of the present application.

For example, as shown in FIG. 12, the snow thrower may also include a printed circuit board (PCB) module 670 which may include a PCB configured to control the motor and/or the battery pack and a heat sink configured to dissipate heat for the PCB. An air path of the snow thrower sequentially passes through the PCB module and the motor 640, that is, a heat dissipation airflow sequentially passes through the PCB module and the motor to dissipate heat for the PCB module and the motor. Of course, in other possible implementations, the heat dissipation airflow may also pass through the battery pack to dissipate heat for the battery pack; and/or the heat dissipation airflow may also pass through other components to dissipate heat for the other components.

It is to be understood that the structures illustrated in the examples of the present application do not constitute specific limitations on the snow thrower. In some other examples of the present application, the snow thrower may include more or fewer components than those shown in the figures, some components may be combined, some components may be split, or different components may be provided.

It is to be understood that the term "and/or" mentioned herein describes an association relationship of associated objects and represents that three relationships may exist. For example, A and/or B may represent the following three cases: only A exists, both A and B exist, and only B exists. The character "/" generally indicates an "or" relationship between associated objects.

It is to be understood that in the present application, unless otherwise expressly specified and limited, the term "coupled", "connected to each other", or "connected" is to be construed in a broad sense, for example, as fixedly connected, detachably connected, or integrated; mechanically connected or electrically connected; directly connected to each other or indirectly connected to each other via an intermediary; or internally connected between two elements or an interaction relation between two elements. For those skilled in the art, specific meanings of the preceding terms in the present application may be understood based on specific situations.

What is claimed is:

1. A snow thrower, comprising a handle system, the handle system comprising a handle assembly and a temperature control module;

wherein the handle assembly comprises a grip and a temperature switch, the temperature control module is configured to heat the grip, the temperature switch is disposed on a heating path from the temperature control module to the grip, the temperature switch is in an off state when a temperature of the grip is higher than a first threshold, and the temperature switch is in an on state when the temperature of the grip is lower than a second threshold;

wherein the handle system comprises a signal collection module capable of sending a working signal to the temperature control module and a temperature detection module configured to collect the temperature of the grip and send the temperature of the grip to the signal collection module; and wherein the signal collection module is configured to determine, based on a stored preset correspondence, a pulse-width modulation (PWM) signal corresponding to the temperature of the grip and send the PWM signal to the temperature control module, the preset correspondence comprises at least one correspondence between the temperature and the PWM signal, and the temperature control module is further configured to heat the grip based on the PWM signal.

2. The snow thrower according to claim 1, wherein the handle system further comprises a handle heating switch, the handle heating switch is configured to enable and disable a handle heating function, the signal collection module is coupled to the handle heating switch and the temperature control module separately, the signal collection module is configured to collect an operation signal of the handle heating switch and send a working signal to the temperature control module when the operation signal is a function enabling signal, and the temperature control module is configured to heat the grip based on the working signal.

3. The snow thrower according to claim 2, wherein the working signal comprises a first output signal for indicating that heating is performed with a first output parameter.

4. The snow thrower according to claim 3, wherein the the temperature detection module is coupled to the grip and the signal collection module separately, the temperature detection module is configured to collect the temperature of the grip and send the temperature of the grip to the signal collection module, the signal collection module is further configured to adjust the first output signal to a second output signal when the temperature of the grip reaches a preset temperature, the second output signal is used for indicating that the heating is performed with a second output parameter, and the first output parameter is greater than the second output parameter.

5. The snow thrower according to claim 2, wherein the temperature detection module is coupled to the grip and the signal collection module separately, the signal collection module is further configured to send a third output signal to the temperature control module based on the temperature of the grip, wherein the third output signal is used for indicating that heating is performed with a third output parameter, and the temperature control module is further configured to heat the grip based on the third output signal.

6. The snow thrower according to claim 1, wherein the temperature detection module is coupled to the grip and the temperature control module separately, the temperature detection module is configured to collect the temperature of the grip and output a voltage based on the temperature of the grip, and the temperature control module is configured to determine a fourth output parameter based on the voltage and heat the grip with the fourth output parameter.

7. The snow thrower according to claim 2, wherein the signal collection module is further configured to send a working stopping signal to the temperature control module when the operation signal is a function disabling signal, and the temperature control module is further configured to stop heating the grip when the working stopping signal is received.

8. The snow thrower according to claim 1, wherein the handle system further comprises a controller, the controller is configured to stop an output of a power supply when no operation signal from another circuit is received within a preset period so that the temperature control module stops heating the grip.

9. The snow thrower according to claim 1, wherein a first resistance wire is wound in the grip, and the temperature control module is configured to heat the grip by outputting a current to the first resistance wire.

10. The snow thrower according to claim 9, wherein a second resistance wire and a third resistance wire are wound in the grip, a first end of the second resistance wire and a first end of the third resistance wire are coupled to the temperature switch separately, and a second end of the second resistance wire and a second end of the third resistance wire are coupled to the temperature control module separately, and the temperature control module, the second resistance wire, the temperature switch, and the third resistance wire form a closed loop.

11. The snow thrower according to claim 1, wherein a heated region of the grip exhibits a first color when the temperature of the grip is lower than a third threshold, and the heated region of the grip exhibits a second color when the temperature of the grip is higher than the third threshold.

12. The snow thrower according to claim 11, wherein a heated region of the grip exhibits a third color when the temperature of the grip is lower than a fourth threshold, the heated region of the grip exhibits a fourth color when the temperature of the grip is higher than the fourth threshold and lower than a fifth threshold, and the heated region of the grip exhibits a fifth color when the temperature of the grip is higher than the fifth threshold.

13. The snow thrower according to claim 1, further comprising a motor and a battery pack electrically connected to the motor to power the motor, wherein the battery pack is further configured to power the temperature control module.

14. The snow thrower according to claim 1, wherein the grip comprises a left grip and a right grip, the temperature switch comprises a first temperature switch and a second temperature switch, a temperature control module is configured to heat the left grip and the right grip, the first temperature switch is disposed on a heating path from the temperature control module to the left grip, the first temperature switch is configured to be in an off state when a temperature of the left grip is higher than a first threshold, and the first temperature switch is configured to be in an on state when the temperature of the left grip is lower than a second threshold, the second temperature switch is disposed on a heating path from the temperature control module to the right grip, the second temperature switch is configured to be in the off state when a temperature of the right grip is higher than the first threshold, and the second temperature switch is configured to be in the on state when the temperature of the right grip is lower than the second threshold.

15. A power tool, comprising a handle assembly, a power supply, and a temperature control module;

wherein the handle assembly comprises a left grip and a right grip, a first end of the left grip is coupled to a body of the power tool, a second end of the left grip is coupled to the right grip, a second end of the right grip is coupled to the body of the power tool, the temperature control module is coupled to the handle assembly and the power supply separately, and the power supply is configured to power the temperature control module so that the temperature control module is configured to heat the handle assembly; and wherein the handle assembly comprises a signal collection module capable of sending a working signal to the temperature control module and a temperature detection module configured to collect the temperature of at least one of the left grip or the right grip and send the collected temperature to the signal collection module, the temperature detection module includes a negative temperature coefficient (NTC) temperature detection module.

16. The power tool according to claim 15, wherein the handle assembly further comprises a first temperature switch and a second temperature switch, the first temperature switch is disposed on a heating path from the temperature control module to the left grip, the first temperature switch is configured to be in an off state when a temperature of the left grip is higher than a first threshold, and the first temperature switch is configured to be in an on state when the temperature of the left grip is lower than a second threshold, and the second temperature switch is disposed on a heating path from the temperature control module to the right grip, the second temperature switch is configured to be in the off state when a temperature of the right grip is higher than the first threshold, and the second temperature switch is configured to be in the on state when the temperature of the right grip is lower than the second threshold.

17. The power tool according to claim 15, wherein a first resistance wire is wound in the left grip, the temperature control module is configured to heat the left grip by outputting a current to the first resistance wire, and a second resistance wire is wound in the right grip, and the temperature control module is configured to heat the right grip by outputting a current to the second resistance wire.

18. The power tool according to claim 17, wherein a third resistance wire is wound in the handle assembly and passes through the left grip and the right grip.

19. The snow thrower according to claim 1, wherein the temperature detection module includes a negative temperature coefficient (NTC) temperature detection module.

* * * * *